US011427879B2

(12) United States Patent
Sohmshetty et al.

(10) Patent No.: US 11,427,879 B2
(45) Date of Patent: Aug. 30, 2022

(54) DIE CONSTRUCTION METHODOLOGY FOR REDUCING QUENCH TIME FOR PRESS HARDENABLE STEELS

(71) Applicant: Ford Global Technologies, LLC, Dearborn, MI (US)

(72) Inventors: Raj Sohmshetty, Canton, MI (US); Constantin Chiriac, Windsor (CA); S. George Luckey, Jr., Dearborn, MI (US); Feng Ren, West Bloomfield, MI (US); Ilya Popov, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 695 days.

(21) Appl. No.: 15/969,312

(22) Filed: May 2, 2018

(65) Prior Publication Data

US 2019/0338387 A1 Nov. 7, 2019

(51) Int. Cl.
*C21D 9/46* (2006.01)
*C22C 38/02* (2006.01)
(Continued)

(52) U.S. Cl.
CPC ..... *C21D 9/46* (2013.01); *B21D 37/01* (2013.01); *C21D 1/673* (2013.01); *C21D 6/004* (2013.01);
(Continued)

(58) Field of Classification Search
CPC ..... C22C 38/12; C22C 38/44; C21D 1/673; C21D 6/004; C21D 6/005; C21D 9/46
See application file for complete search history.

(56) References Cited

U.S. PATENT DOCUMENTS

2009/0320547 A1* 12/2009 Horton ..... B21D 37/16 72/342.3
2015/0114525 A1* 4/2015 Valls Angles ..... C22C 38/38 148/612
2018/0222536 A1* 8/2018 Frehn ..... B32B 15/01
2019/0202003 A1* 7/2019 Molina Mesa ..... B21D 22/02

FOREIGN PATENT DOCUMENTS

CN 102676923 9/2012
CN 203002965 6/2013
(Continued)

OTHER PUBLICATIONS

Etienne J.F.R. Caron, Kyle J. Daun, Mary A. Wells. "Experimental heat transfer coefficient measurements during hot forming die quenching of boron steel at high temperatures." International Journal of Heat and Mass Transfer 71, 396-404 (2014) (Year: 2014).*
(Continued)

*Primary Examiner* — Anthony J Zimmer
*Assistant Examiner* — Sean P. O'Keefe
(74) *Attorney, Agent, or Firm* — Burris Law, PLLC

(57) ABSTRACT

A method of quenching a press hardenable steel (PHS) is provided. The method includes preparing a die having a material with a thermal conductivity of at least 40W/(m·K) and placing a blank within the die and simultaneously hot stamping and quenching the blank at a heat transfer coefficient of at least 2,950W/($m^2$·K). In one form, the step of hot stamping the blank is carried out with greater than 20 MPa of contact pressure between the die and the blank. In another form, the step of hot stamping the blank is carried out with 31 MPa of contact pressure between the die and the blank.

12 Claims, 5 Drawing Sheets

(51) Int. Cl.

| | |
|---|---|
| ***C21D 8/02*** | (2006.01) |
| ***C21D 6/00*** | (2006.01) |
| ***C22C 38/04*** | (2006.01) |
| ***C21D 1/673*** | (2006.01) |
| ***B21D 37/01*** | (2006.01) |
| ***B21D 22/02*** | (2006.01) |
| ***C22C 38/46*** | (2006.01) |
| ***C22C 38/44*** | (2006.01) |

(52) U.S. Cl.

CPC ..... *C21D 6/005* (2013.01); *C21D 6/008* (2013.01); *C21D 8/0205* (2013.01); *C22C 38/02* (2013.01); *C22C 38/04* (2013.01); *C22C 38/44* (2013.01); *C22C 38/46* (2013.01); *B21D 22/022* (2013.01)

(56) References Cited

FOREIGN PATENT DOCUMENTS

| | | |
|---|---|---|
| CN | 103993223 | 8/2014 |
| CN | 104313462 | 1/2015 |
| CN | 104294020 | 11/2016 |
| WO | 2014/037072 | 3/2014 |

OTHER PUBLICATIONS

Hay (Bakri Abdul Hay, Brahim Bourouga, Christine Dessain. "Thermal contact resistance estimation at the blank/tool interface: experimental approach to simulate the blank cooling during the hot stamping process." Int J Mater Form 3:147-163 (2010) (Year: 2010).*

ASM Handbook, Properties and Selection: Irons, Steels, and High-Performance Alloys, vol. 1, ASM International, Materials Park, OH, pp. 195-199 (1990). (Year: 1990).*

Joseba Mendiguren, Rafael Ortubay, Eneko Saenz de Argandoña, and Lander Galdos. "Experimental characterization of the heat transfer coefficient underdifferent close loop controlled pressures and die temperatures."Applied Thermal Engineering 99: 813-824 (2016)) (Year: 2016).*

Chang, Ying, et al. "Investigation of the factors influencing the interfacial heat transfer coefficient in hot stamping." Journal of Materials Processing Technology 228 (2016): 25-33. (Year: 2016).*

Wang, Min, et al. "Inverse evaluation of equivalent contact heat transfer coefficient in hot stamping of boron steel." The International Journal of Advanced Manufacturing Technology 87.9 (2016): 2925-2932 (Year: 2016).*

* cited by examiner

| Element | Minimum wt.% | Maximum wt.% |
|---|---|---|
| Boron | > 0 | 0.005 |
| Carbon | > 0 | 0.37 |
| Manganese | > 0 | 1.4 |
| Silicon | > 0 | 0.7 |
| Iron | Balance | Balance |

DIE CONSTRUCTION METHODOLOGY FOR REDUCING QUENCH TIME FOR PRESS HARDENABLE STEELS

FIELD

The present disclosure relates to high strength press hardenable steels and methods of hot stamping blanks of such steels.

BACKGROUND

The statements in this section merely provide background information related to the present disclosure and may not constitute prior art.

There is an increasing demand to reduce the weight of vehicle structures while meeting various strength and safety requirements, leading vehicle teams to investigate high strength steels. One category of high strength steel is Boron-based steel, with 22MnB5 grade steel with an Al—Si coating (Usibor® brand Boron-based steel from Arcelor Mittal) as an industry leading Boron-based steel. Typical material properties for 22MnB5 grade steel after heat treatment are about 1,200 MPa yield strength and about 1,500 MPa ultimate tensile strength.

22MnB5 grade steel is a press hardenable steel (PHS). The press hardening process is a hot stamping process that allows high strength steels to be formed into complex shapes, which is not feasible (or cost-prohibitive) with regular cold stamping operations. Press hardening has two main processes: direct press hardening and indirect press hardening.

During direct press hardening, an unformed blank is heated in a furnace, formed in a hot condition in a cold die, and quenched in the die to achieve the desired mechanical properties. During indirect press hardening, an unformed blank is formed, trimmed, and pierced in a room temperature, and the formed blank is then heated and quenched in a die to obtain the desired mechanical properties. The choice of direct or indirect press hardening depends on part complexity and blank coating (Zinc-based coatings typically require indirect processes). In either method, the blank is formed in a much softer and formable state and is later hardened in the dies. High strength steels have a formability that is lower than milder grades. In addition, high strength steels have higher springback and die wear issues as the forming stresses and contact pressures are higher.

A new grade of PHS is 36MnB5 grade steel (Usibor® 2000 brand Boron-based steel from Arcelor Mittal) is a new grade of Boron-based steel and has potential to further reduce the weight of hot stamped parts. Further, 36MnB5 grade steel has the potential to achieve material properties after heat treatment of greater than 1,400 MPa yield strength and greater than 2,000 MPa ultimate tensile strength. 36MnB5 grade steel requires a significantly lower part extraction temperature than 22MnB5 grade steel to achieve the target mechanical properties resulting in a 1.5-5 second increase in die quenching time over 22MnB5 grade steel. An increase in die quench time between 22MnB5 grade steel and 36MnB5 grade steel of 5 seconds, results in at least a 10% increase in processing costs. To date, an increase in time of greater than or equal to 1 second has been considered cost-prohibitive for low-volume production replacement of 22MnB5 grade steel with 36MnB5 grade steel.

Further, 36MnB5 grade steel is more sensitive to variations in cooling profiles than 22MnB5 grade steel, resulting in higher quality control costs. Processing of 36MnB5 grade steel may require additional costs such as an improved cooling systems, die thermal conductivity, contact pressures and process controls. For at least these reasons 36MnB5 grade steel has not been integrated into vehicle structures.

The present disclosure addresses these issues of press hardening 36MnB5 grade steels to achieve desired mechanical properties, among other issues related to press hardenable steels.

SUMMARY

In one form of the present disclosure, a method of quenching a press hardenable steel (PHS) is provided. The method comprises preparing a die having a material with a thermal conductivity of at least 40 W/(m·K), placing a blank within the die and simultaneously hot stamping and quenching the blank at a heat transfer coefficient of at least 2,950 W/(m$^2$·K).

In another method of the present disclosure, the step of hot stamping the blank is carried out with greater than 20 MPa of contact pressure between the die and the blank. In at least one method of the present disclosure, the step of hot stamping the blank is carried out with 31 MPa of contact pressure between the die and the blank.

In variations of the method of the present disclosure, the PHS has a composition comprising: manganese greater than zero and up to 1.4 wt. %; silicon greater than zero and up to 0.7 wt. %; carbon greater than zero and up to 0.37 wt. %; and boron greater than zero and up to 0.005 wt. %.

In yet another method of the present disclosure, the die material has a hardness of 48 HRc, thermal conductivity of at least 34 W/(m·K) at 600° C., and thermal conductivity of at least 44 W/(m·K) at 0° C.

In a variation of the present disclosure, the heat transfer coefficient is achieved by hydraulic pressure control.

In a method of the present disclosure, the method further comprises a steady state temperature of the die is less than 85° C. In some of these methods of the present disclosure, the steady state temperature of the die is 65° C.

In other methods of the present disclosure, the hot stamped blank has a yield strength greater than 1,400 MPa and a tensile strength greater than 1,900 MPa.

In another form of the present disclosure, a method of quenching a press hardenable steel (PHS) is provided. The method comprises preparing a die having a material with a thermal conductivity greater than 28 W/(m·K), placing a blank within the die and hot stamping the blank at a heat transfer coefficient of at least 2,300 W/(m$^2$·K), and transferring the hot stamped blank to a cooling channel at a distance of less than 10 mm. In variations of the methods of the present disclosure, the distance is 8 mm.

In yet another form of the present disclosure, a method of quenching a press hardenable steel (PHS) is provided. The method comprises preparing a die having a material with a thermal conductivity of at least 28 W/(m·K), placing a blank within the die and hot stamping the blank at a heat transfer coefficient of at least 2,300 W/(m$^2$·K), wherein a steady state temperature of the die is less than 85° C. and cooling the hot stamped blank. In this method, the PHS has a composition comprising: manganese greater than zero and up to 1.4 wt. %; silicon greater than zero and up to 0.7 wt. %; carbon greater than zero and up to 0.37 wt. %; and boron greater than zero and up to 0.005 wt. %.

In other methods of the present disclosure, cooling the hot stamped blank comprises simultaneously quenching the blank with the hot stamping, and the thermal conductivity of the die is at least 40 W/(m·K).

Furthermore, at least one part is manufactured according to the methods of the present disclosure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
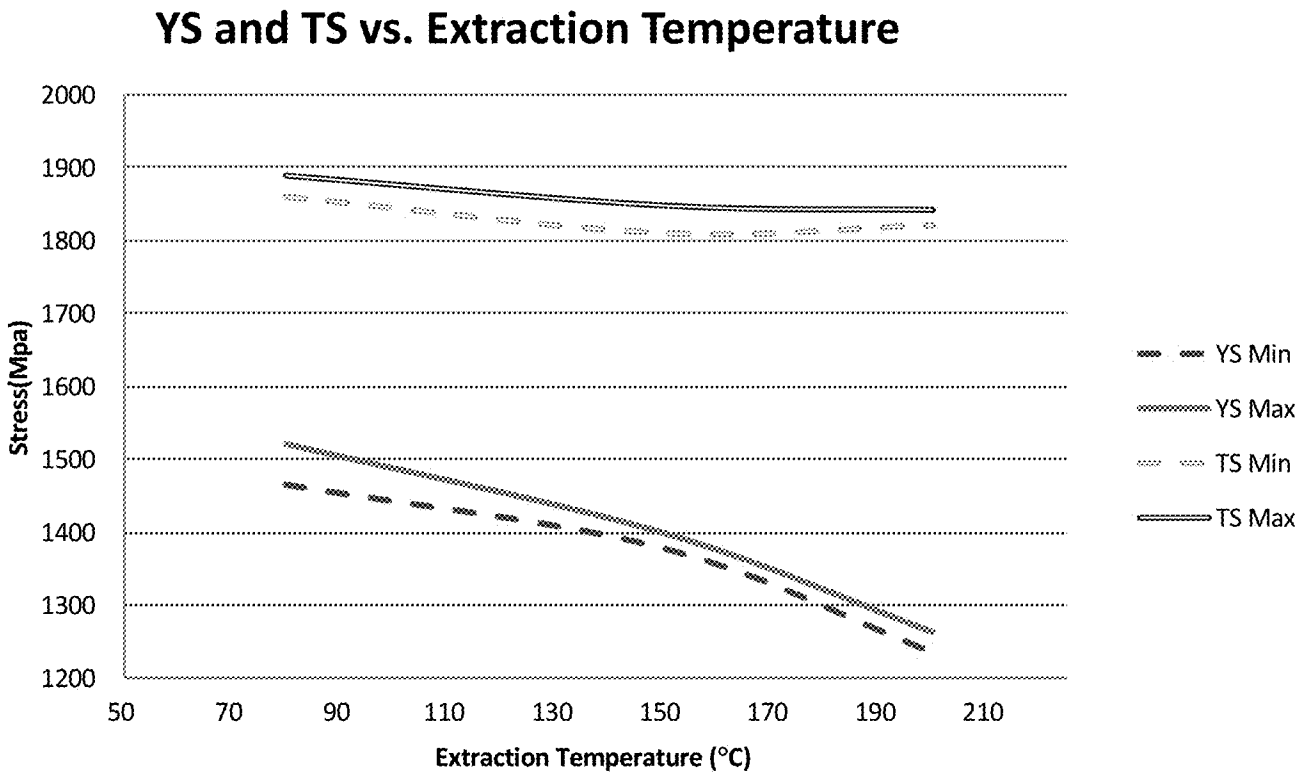
FIG. 1 illustrates the relationship between strength and part extraction temperature for 36MnB5 grade steel according to the discoveries of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Generally, to address the issues related to press hardening a press hardenable steel while using manufacturing equipment designed for 22MnB5 grade press hardenable steel processing, the present disclosure reduces quench time of a higher grade press hardenable steel to about the quench time for the 22MnB5 grade steel.

The inventors discovered that between production conditions for 22MnB5 grade steel and 36MnB5 grade steel, die quench time for 36MnB5 grade steel would be significantly higher than 22MnB5 grade steel. The inventors also discovered that the yield strength (YS) and the ultimate tensile strength (UTS) of 36MnB5 grade steel would be lower than the specification using existing production equipment/processing for 22MnB5 grade steel. This is reflected below in Table 1:

TABLE 1

| Specimen | YS (MPa) | UTS (MPa) | % EL | Part Extraction Temperature |
|---|---|---|---|---|
| 22MnB5 PHS #112 | 1013 | 1456 | 18 | ~210° C. |
| 22MnB5 PHS #114 | 1050 | 1468 | 17 | ~210° C. |
| Ave | 1031.5 | 1462 | 17.5 | |
| 36MnB5 PHS #109 | 1247 | 1824 | 12 | |
| 36MnB5 PHS #110 | 1235 | 1821 | 15 | ~210° C. |
| Ave | 1241 | 1822.5 | 13.5 | ~210° C. |
| Specification | ≥1400 | ≥1800 | ≥4 | |

As shown, 22MnB5 grade steel properties for Yield Strength (YS) and Ultimate Tensile Strength (UTS) are within the specification for typical production part extraction temperature of about 200° C. However, the yield strength for 36MnB5 grade steel processed with 22MnB5 grade steel typical production part extraction temperatures were below the 36MnB5 specification yield strength of greater than or equal to 1,400 MPa.

Referring to FIG. 1, the relationship between strength and part extraction temperature for 36MnB5 grade steel processed with 22MnB5 grade steel hot-stamping tooling and procedures is shown as discovered by the inventors. As illustrated, the tensile strength (TS) of the 36MnB5 grade steel is relatively constant (≤75 MPa) with respect to the part extraction temperature over the range of about 75-200° C. However, the yield strength of the 36MnB5 grade steel is varies by about 300 MPa and is therefore dependent upon the part extraction temperature over the range of about 75-200° C. The desired yield strength for 36MnB5 grade steel is greater than 1,400 MPa, which shows that 36MnB5 grade steel is enabled for production when the part extraction temperature is below about 130° C.

Figure 2:
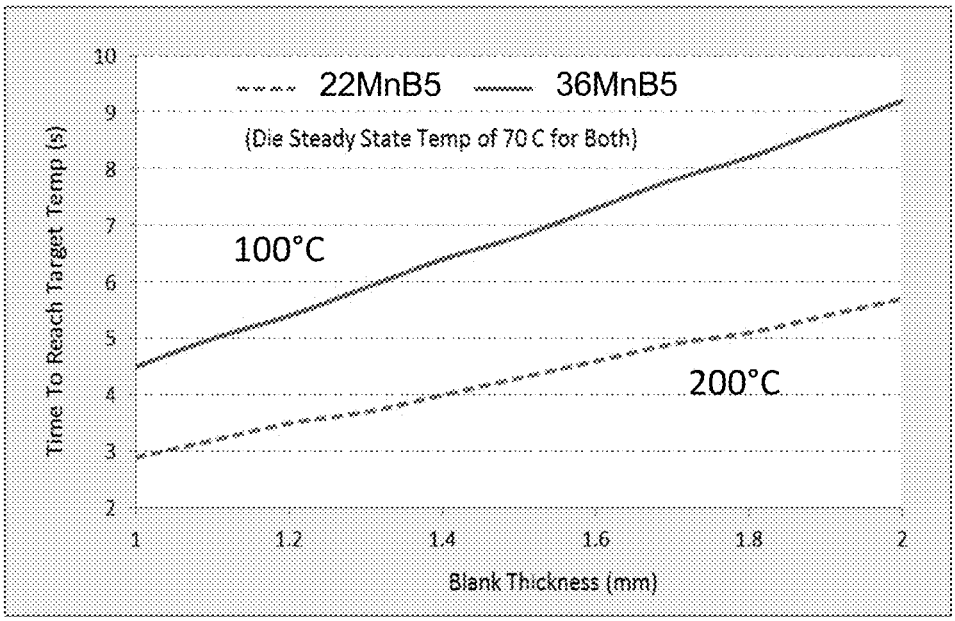
FIG. 2 illustrates the relationship between the cooling rate and the blank thickness for 22MnB5 and 36MnB5 grade steels according to the discoveries of the present disclosure.
Figure 3:
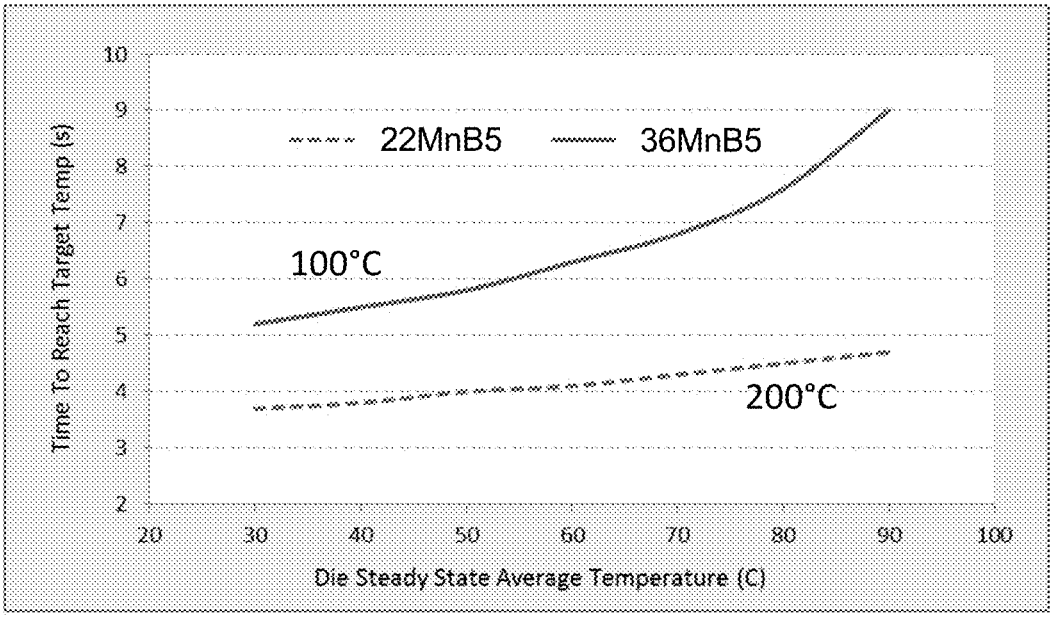
FIG. 3 illustrates the relationship between the cooling rate and the die temperature for 22MnB5 and 36MnB5 grade steels according to the discoveries of the present disclosure.

Referring to FIGS. 2-3, the differences to reach the target temperatures for 22MnB5 grade steel and 36MnB5 grade steel are plotted with respect to blank thickness (FIG. 2) and die steady state temperature (FIG. 3) as discovered by the inventors. The inventors discovered that the difference in time to reach the target extraction temperatures for 36MnB5 grade steel versus 22MnB5 grade steel varies by 1.5-5 seconds. These results showed that the mechanical properties of 36MnB5 grade steel are more sensitive to variations in the cooling systems (quenching technology and processes) than 22MnB5 grade steel.

Figure 4:
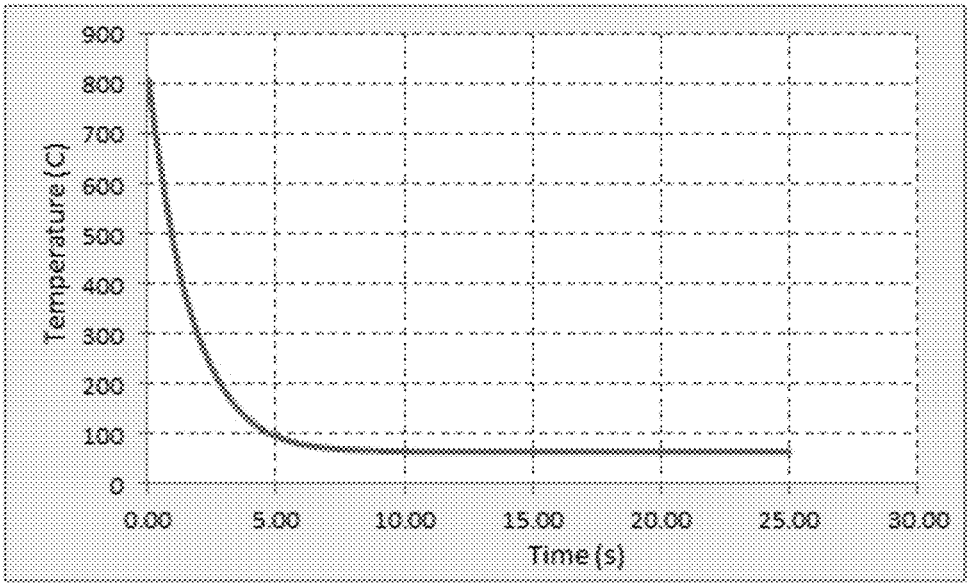
FIG. 4 illustrates the relationship between blank temperature and time for a 1.5 mm 36MnB5 grade steel blank to cool from about 830° C. to about 100° C. according to the teachings of the present disclosure.
Figure 5:
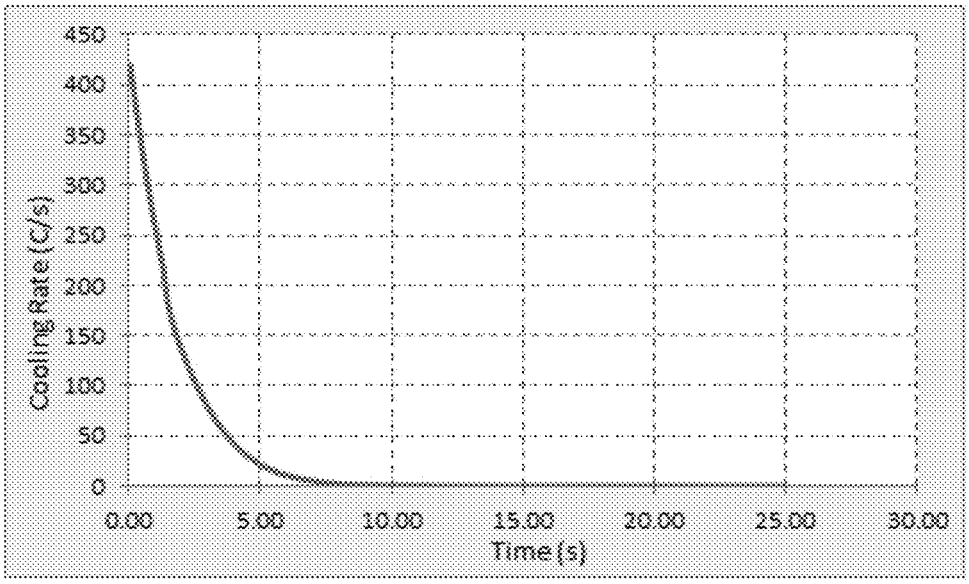
FIG. 5 illustrates the relationship between cooling rate and time for a 1.5 mm 36MnB5 grade steel blank to cool from about 830° C. to about 100° C. according to the teachings of the present disclosure.

According to the present disclosure, one method to reduce 36MnB5 grade steel quench time is to reduce the Time-Temperature-Transformation (TTT) relationship and therefore the time to quench the 36MnB5 grade steel. Numerous analyses and testing resulted in the processing parameters of TABLE 2 below and the relationships shown in FIG. 4 and FIG. 5.

TABLE 2

| | 22MnB5 grade steel | 36MnB5 grade steel |
|---|---|---|
| Plate thickness (mm) | 1.5 | 1.5 |
| Die Contact Pressure (MPa) | 19.1 | 31 |
| Die contact heat transfer coefficient (W/K*m^2) | 2302 | 2943 |
| Die thermal conductivity (W/K*m) | 28 | 45 |
| Die surface absorptivity | 0.6 | 0.6 |
| Die steady state average temperature (° C.) | 83 | 65 |
| Part quench temperature (° C.) | ~200 ± 10 | <130 |

TABLE 2-continued

| | 22MnB5 grade steel | 36MnB5 grade steel |
|---|---|---|
| Time to quench (seconds) | ~4.7 | ~4.8 |
| Distance to cooling channel (mm) | 10 | 8 |

The die contact pressure is the pressure between the die and the steel blank, and the distance to cooling channel is the distance between the center of the cooling channel to the die contact surface. Further, as die thermal conductivity increases, the abrasive resistance of the die reduces, therefore an abrasive resistant coating and/or surface hardening of the dies may be desired.

Figure 6:
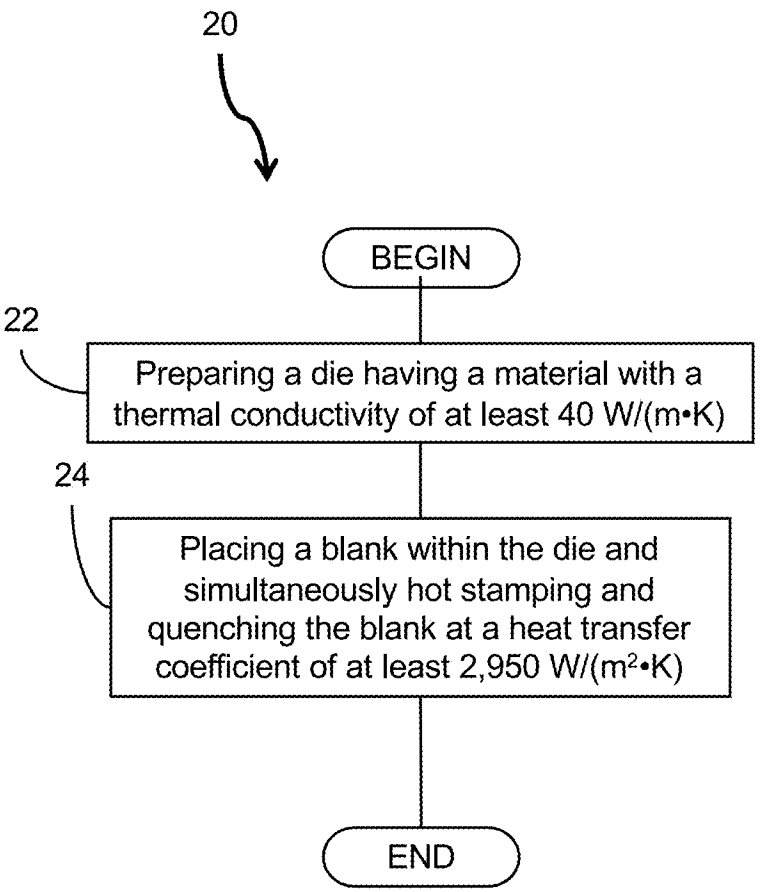
FIG. 6 is a flowchart for a method of quenching a press hardenable steel according to the teachings of the present disclosure.

Referring to FIG. 6, in one form of the present disclosure, a method 20 of quenching a press hardenable steel (PHS) is provided. At step 22, the method 20 comprises preparing a die having a material with a thermal conductivity of at least 40 W/(m·K). At step 24, the method 20 comprises placing a blank within the die and simultaneously hot stamping and quenching the blank at a heat transfer coefficient of at least 2,950 W/($m^2$·K).

In another method of the present disclosure, the step of hot stamping the blank is carried out with greater than 20 MPa of contact pressure between the die and the blank. In at least one method of the present disclosure, the step of hot stamping the blank is carried out with 31 MPa of contact pressure between the die and the blank.

In variations of the method of the present disclosure, the PHS has a composition comprising: manganese greater than zero and up to 1.4 wt. %; silicon greater than zero and up to 0.7 wt. %; carbon greater than zero and up to 0.37 wt. %; and boron greater than zero and up to 0.005 wt. %, as shown below in TABLE 3:

TABLE 3

| Element | Minimum wt. % | Maximum wt. % |
|---|---|---|
| Boron | >0 | 0.005 |
| Carbon | >0 | 0.37 |
| Manganese | >0 | 1.4 |
| Silicon | >0 | 0.7 |
| Iron | Balance | Balance |

In yet another method of the present disclosure, the die material has a hardness of 48 HRc, thermal conductivity of at least 34 W/(m·K) at 600° C., and thermal conductivity of at least 44 W/(m·K) at 0° C. This die material has a composition, as shown in TABLE 4:

TABLE 4

| Element | Minimum wt. % | Maximum wt. % | Die Material 600 wt. % | Die Material 620 wt. % |
|---|---|---|---|---|
| Carbon | 0.32 | 0.5 | 0.32 | 0.32 |
| Chromium | 0 | 5 | 0 | 0 |
| Manganese | 0.2 | 0.3 | 0.25 | 0.25 |
| Molybdenum | 3.0 | 3.3 | 3.3 | 3.3 |
| Nickel | 0 | 2 | 2 | 0 |
| Silicon | 0.1 | 0.2 | 0.1 | 0.12 |
| Tungsten | 0 | 2 | 1.8 | 1.8 |
| Vanadium | 0 | 0.6 | 0 | 0 |
| Iron | Balance | Balance | Balance | Balance |

In a variation of the present disclosure, the heat transfer coefficient is achieved by hydraulic pressure control.

In a method of the present disclosure, the method further comprises a steady state temperature of the die is less than 85° C. In some of these methods of the present disclosure, the steady state temperature of the die is 65° C.

In other methods of the present disclosure, the hot stamped blank has a yield strength greater than 1,400 MPa and a tensile strength greater than 1,900 MPa.

Figure 7:
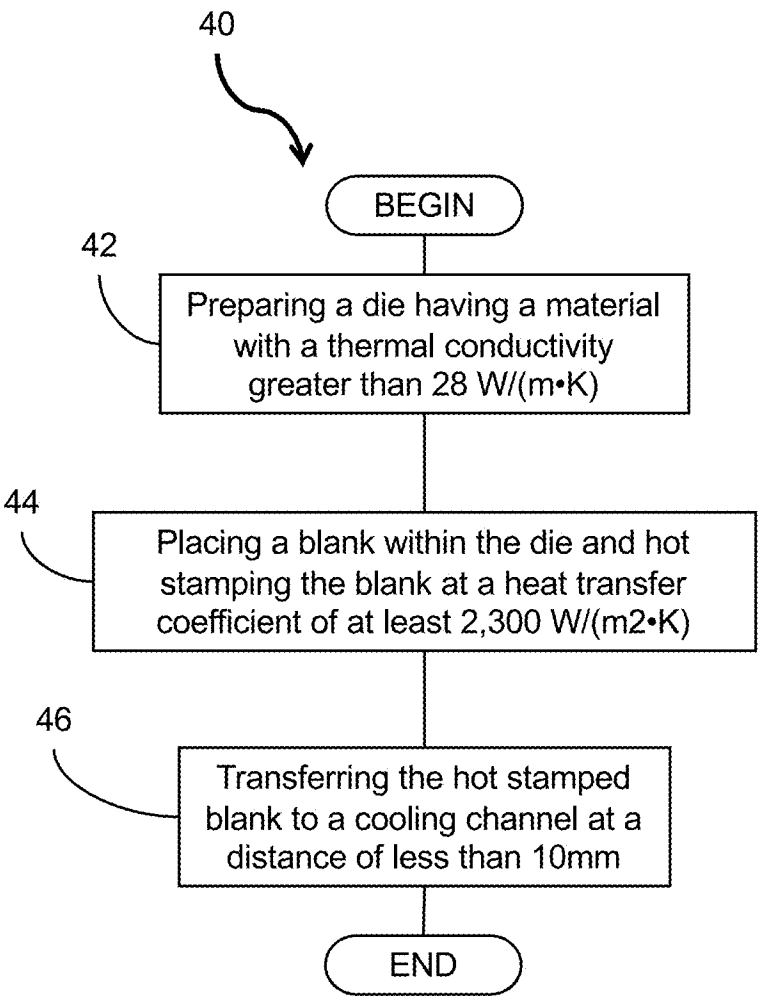
FIG. 7 is a flowchart for another method of quenching a press hardenable steel according to the teachings of the present disclosure.

Now referring to FIG. 7, in another form of the present disclosure, a method 40 of quenching a press hardenable steel (PHS) is provided. At step 42, the method 40 comprises preparing a die having a material with a thermal conductivity greater than 28 W/(m·K). At step 44, the method 40 comprises placing a blank within the die and hot stamping the blank at a heat transfer coefficient of at least 2,300 W/($m^2$·K). At step 46, the method 40 comprises transferring the hot stamped blank to a cooling channel at a distance of less than 10 mm. In variations of the methods of the present disclosure, the distance is 8 mm.

Figure 8:
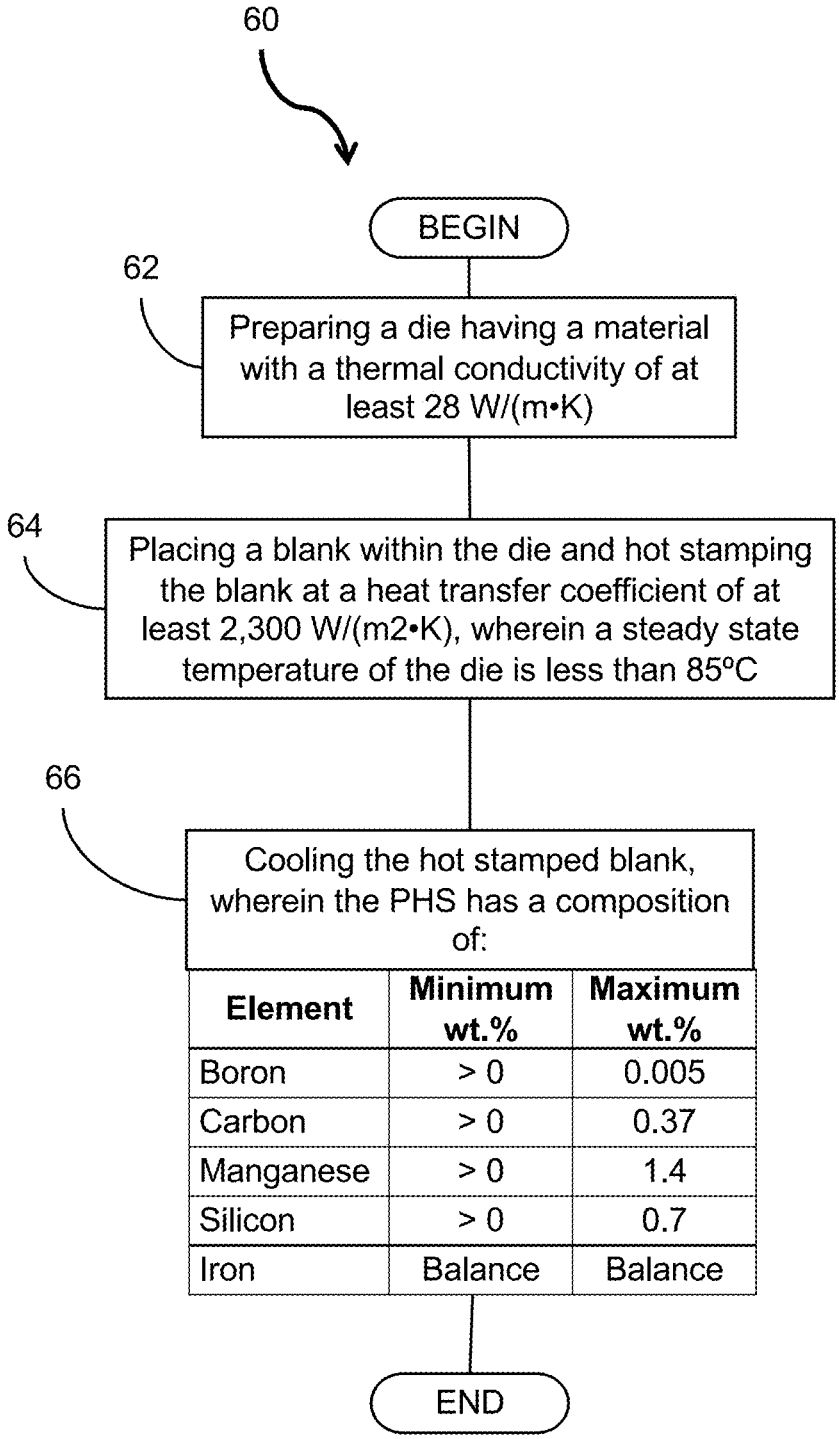
FIG. 8 is a flowchart for yet another method of quenching a press hardenable steel according to the teachings of the present disclosure.

Referring to FIG. 8, in yet another form of the present disclosure, a method 60 of quenching a press hardenable steel (PHS) is provided. At step 62, the method 60 comprises preparing a die having a material with a thermal conductivity of at least 28 W/(m·K). At step 64, the method 60 comprises placing a blank within the die and hot stamping the blank at a heat transfer coefficient of at least 2,300 W/($m^2$·K), wherein a steady state temperature of the die is less than 85° C. At 66, the method 60 comprises cooling the hot stamped blank. In this method, the PHS has a composition comprising: manganese greater than zero and up to 1.4 wt. %; silicon greater than zero and up to 0.7 wt. %; carbon greater than zero and up to 0.37 wt. %; and boron greater than zero and up to 0.005 wt. %.

In other methods of the present disclosure, cooling the hot stamped blank comprises simultaneously quenching the blank with the hot stamping, and the thermal conductivity of the die is at least 40 W/(m·K).

Furthermore, at least one part is manufactured according to the methods of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of quenching a press hardenable steel (PHS) comprising:

preparing a die having a material with a thermal conductivity of at least 40 W/(m·K); and placing a blank within the die and simultaneously hot stamping and quenching the blank at a heat transfer coefficient greater than or equal to 2300 W/($m^2$·K) and less than or equal to 2950 W/($m^2$·K) to a temperature of less than 130° C. and quench time of less than 5 seconds, the hot stamped blank having a yield strength greater than 1,400 MPa, wherein the step of hot stamping the blank is carried out with 31 MPa of contact pressure between the die and the blank.

2. The method according to claim 1, wherein the PHS has a composition comprising:

manganese greater than zero and up to 1.4 wt. %;

silicon greater than zero and up to 0.7 wt. %;

carbon greater than zero and up to 0.37 wt. %; and boron greater than zero and up to 0.005 wt. %.

3. The method according to claim 1, wherein the die material has a hardness of 48 HRc thermal conductivity of at least 34 W/(m·K) at 600° C. and thermal conductivity of at least 44 W/(m·K) at 0° C.

4. The method according to claim 1, wherein the heat transfer coefficient is achieved by hydraulic pressure control.

5. The method according to claim 1, further comprises a steady state temperature of the die is less than 85° C.

6. The method according to claim 5, wherein the steady state temperature of the die is 65° C.

7. The method according to claim 1, wherein the hot stamped blank has a tensile strength greater than 1,900 MPa.

8. A method of quenching a press hardenable steel (PHS) comprising:

preparing a die having a material with a thermal conductivity greater than 28 W/(m·K), a die contact surface, and a cooling channel; and placing a blank within the die and hot stamping the blank with 31 MPa of contact pressure between the die and the blank at a heat transfer coefficient greater than or equal to 2300 W/($m^2$·K) and less than or equal to 2950 W/($m^2$·K) to a temperature of less than 130° C. and quench time of less than 5 seconds, wherein a distance between a center of the cooling channel and the die contact surface is less than 10 mm.

9. The method according to claim 8, wherein the distance is 8 mm.

10. The method according to claim 8, wherein the PHS has a composition comprising:

manganese greater than zero and up to 1.4 wt. %;

silicon greater than zero and up to 0.7 wt. %;

carbon greater than zero and up to 0.37 wt. %; and boron greater than zero and up to 0.005 wt. %.

11. The method according to claim 8, further comprising a steady state temperature of the die is less than 85° C.

12. The method according to claim 8, wherein the hot stamped blank has a yield strength greater than 1,400 MPa and a tensile strength greater than 1,900 MPa.

* * * * *